United States Patent [19]

Johnson et al.

[11] 4,329,803

[45] May 18, 1982

[54] ELECTRONIC SET TRIGGER

[75] Inventors: Myron L. Johnson, Simsbury, Conn.; Joseph A. Badali, Ogden, Utah

[73] Assignee: Browning Arms Company, Morgan, Utah

[21] Appl. No.: 166,593

[22] Filed: Jul. 7, 1980

[51] Int. Cl.[3] ..... F41C 19/12

[52] U.S. Cl. ..... 42/84

[58] Field of Search ..... 42/84; 89/28 R, 28 A, 89/135

[56] References Cited

U.S. PATENT DOCUMENTS

| | | | |
|---|---|---|---|
| 2,337,145 | 12/1943 | Albree | 42/84 |
| 3,250,034 | 5/1966 | Simmons | 42/84 |
| 3,453,764 | 7/1969 | Grolleau | 42/84 |
| 3,626,624 | 12/1971 | Green | 42/84 |
| 3,738,043 | 6/1973 | Green | 42/84 |
| 4,009,536 | 3/1977 | Wolff | 42/84 |

*Primary Examiner*—Charles T. Jordan

*Attorney, Agent, or Firm*—Trask & Britt

[57] ABSTRACT

An electronic set trigger is mounted in association with the mechanical firing mechanism of a rifle. The rifle may be fired in normal fashion through the normal mechanical linkage associated with a trigger lever. When a set trigger is desired, the electronic set trigger is activated by depressing a switch which activates a charging circuit to charge a capacitor carried within the firearm. The capacitor is discharged by pressing a switch associated with the trigger lever thereby discharging a capacitor through a solenoid coil associated with a reciprocating core mechanically linked to the trigger lever.

10 Claims, 23 Drawing Figures

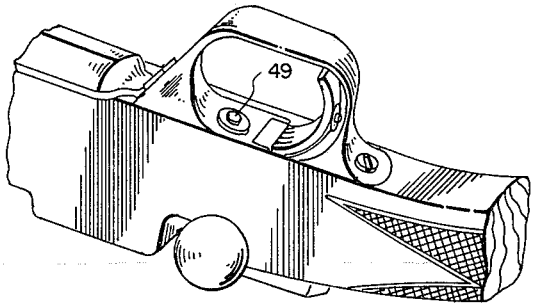
Fig. 5
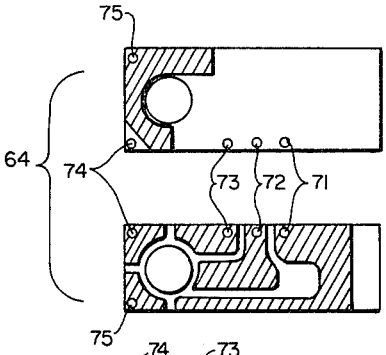
Fig. 6A
Fig. 6B
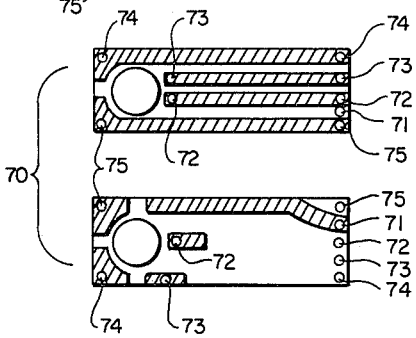
Fig. 6C
Fig. 6D
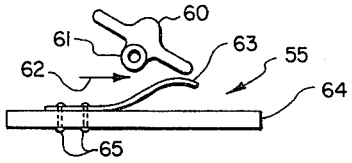
Fig. 7A
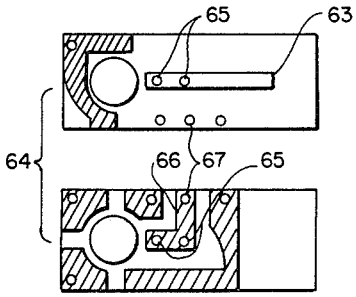
Fig. 7B
Fig. 7C

ELECTRONIC SET TRIGGER

BACKGROUND OF THE INVENTION

1. Field

This invention relates to electronic triggers and specifically to electronic set triggers for target rifles. It provides an improved set trigger which may be used optionally, and is mounted within a firearm in association with its normal mechanical firing mechanism.

2. State of the Art

U.S. Pat. Nos. 3,626,624 and 3,738,043 disclose an electro-mechanical free pistol referred to as an "in line" electrically actuated mechanical firing mechanism. According to those patents, a solenoid is mounted in a target pistol in association with a sear. The reciprocating core associated with the solenoid coil is connected directly to the sear and is adapted to move the sear in response to an electrical discharge through the coil. Appropriate electronic circuitry and a battery are contained within the frame of the pistol, and the mechanical trigger normally present in firearms of this type is replaced by an electrical switch.

Firearms of the type described by these patents are ideal for target contests, but are of small use for other applications, such as field sports. The extremely light touch provided by the electro-mechanical system is unsafe in other than target shooting environments.

There is a need in the art for an electro-mechanical system which will provide very light touch triggers for "set shot" circumstances without sacrificing the normal operation of the firearm for use in field sports.

SUMMARY OF THE INVENTION

The present invention provides an electronic set trigger in association with the mechanical trigger of a firearm. As typically embodied, the firearm will include a firing mechanism including a sear operable to hold the firing mechanism in cocked condition and to release the firing mechanism from cocked condition to firing condition in response to operation of a trigger lever. According to this invention, the components of an electronic set trigger are arranged to provide an alternative mode of releasing the firing mechanism; i.e., electronically. The electronic mode is used in circumstances where a set trigger is desired.

The electronic set trigger of this invention differs from those of the prior art in that it interfaces mechanically with the trigger lever of the firearm so that electro-mechanical components function to operate the trigger in a fashion entirely analogous to finger pressure. Generally, an electro-mechanical device including a solenoid coil is mounted in the proximity of the trigger guard of the firearm, and a reciprocating core associated with the solenoid coil is mechanically linked to the trigger lever to operate it in place of normal finger pressure. The solenoid coil is activated by discharge of a capacitor in a fashion generally similar to that described by the aforementioned U.S. Pat. Nos. 3,626,624 and 3,738,043, the disclosures of which are incorporated by reference herein. Certain preferred embodiments of the present invention, however, include refinements not present in the prior art as illustrated by the aforementioned U.S. patents. Moreover, in accordance with this invention, the electronic trigger is normally passive and its presence does not interfere with or exclude operation of the mechanical firing system of the firearm. The electronic set trigger of this invention is available for occasional use under certain specified conditions and imposes no additional hazard by virtue of its presence.

The solenoid of the electro-mechanical device which operates the trigger lever in the electronic set trigger mode is energized by discharge of a capacitor. The capacitor is mounted in association with the firearm and in association with a charging circuit and an electronic trigger circuit, as well as a power supply means. A trigger switch, charging switch, and in certain preferred embodiments, an electronic safety switch, are usually carried in association with the frame of the firearm, and the remaining circuit components are usually most conveniently housed within the stock when the firearm happens to be a rifle or shotgun. This invention may be embodied in a hand gun in which case the circuit components may be housed within the band grip portion of the firearm.

In general, the charging circuit comprises a power supply, capacitor and resistance connected in circuit through a charging switch to effect an RC charging circuit with a time constant sufficient to provide safety. That is, to charge the capacitor sufficiently to operate the trigger circuit, it is necessary for one to deliberately close through finger pressure a charging switch for a significant increment of time, normally at least a second or more. (A time constant of about three to about seven seconds is presently regarded as optimum for practical firearms.) Accordingly, the risk of accidental or instantaneous charging of the capacitor is reduced substantially. Of course, it is possible to provide a variable resistance in the charging circuit so that the time constant may be adjusted. Approximately instantaneous charging, while possible, is considered unacceptably hazardous under normal conditions.

A triggering circuit is connected to the solenoid coil opposite the capacitor so that upon closing of the normally open trigger switch current flows through the solenoid thereby moving the reciprocating core to pivot the trigger lever in the same direction as it would normally be pivoted by trigger finger pressure. In most instances, the trigger circuit includes a gate controlled solid state device such as an SCR which normally blocks current flow from the solenoid through the device but which may be biased to allow current flow. The electronic trigger switch is thus ordinarily located in the gate controlled circuit to provide such a bias upon closing of the trigger switch.

It is convenient for the electronic circuits to be connected so that the frame of the gun represents a reference potential, conveniently referred to as "ground" potential within the context of this invention. The power supply is thus isolated from ground by the charging switch while the capacitor is connected parallel the power supply with one side also grounded to the frame of the firearm. The electronic gate controlled solid state device will also be connected between ground and the solenoid as ordinarily will be the gate control circuit through the trigger switch (one terminal of the trigger switch being connected to the frame).

As additional safety features, a bias may be provided in the gate control circuit to safeguard against spurious discharges through the trigger circuit thereby accidentally discharging the gun. Moreover, an electronic safety switch may be installed in conjunction with the mechanical safety so that when the gun is placed on mechanical safe it automatically shunts the capacitor to ground thereby preventing accidental electronic discharges.

Because many of the circuit components are carried within the stock of a rifle, whereas other components, (usually the minimum possible number), are carried in association with the frame of the rifle, it is necessary to provide means for interconnecting these components in circuit relationship. According to this invention, such interconnection is best provided either by a plug connector or by a pair of circuit boards carried by the stock and frame, respectively, to interconnect when the rifle is assembled.

BRIEF DESCRIPTION OF THE DRAWINGS

In the drawings, which illustrate what is presently regarded as the best mode for carrying out the invention.

FIG. 5 is a fragmentary pictorial view illustrating a portion of the bolt action rifle of FIG. 4 in assembled condition;

FIG. 6 is a series of plan views showing circuit board components of one embodiment of this invention, of which FIG. 6A shows the top and 6B the bottom of one circuit board and FIG. 6C shows the top and 6D the bottom of a second circuit board;

FIG. 7 includes three views, of which FIG. 7A is a partial assembly view of the safety mechanism for this invention, FIG. 7B is a top plan view and 7C a bottom plan view of a circuit board component of FIG. 7A;

FIG. 13 includes three views, of which

DESCRIPTION OF THE ILLUSTRATED EMBODIMENTS

Figure 1:
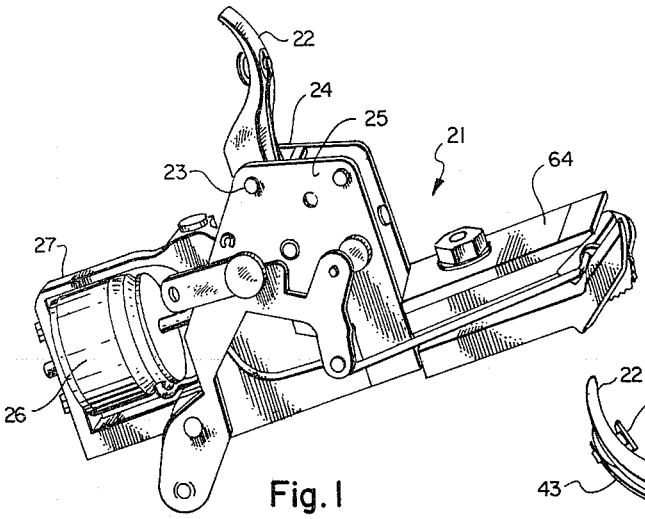
FIG. 1 is a pictorial view of the trigger assembly of this invention as viewed from one side.
Figure 2:
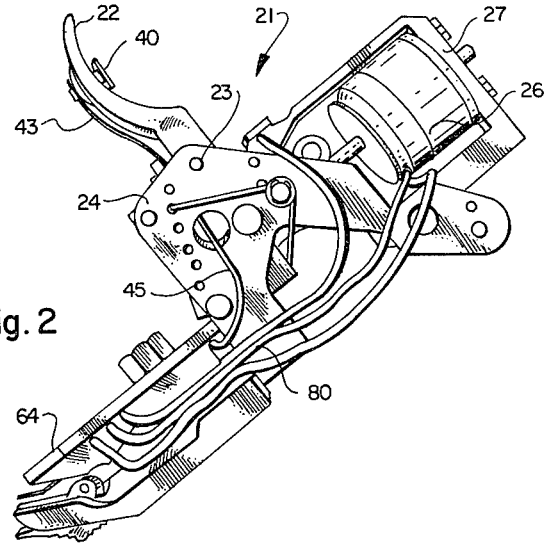
FIG. 2 is a similar pictorial view of the trigger assembly illustrated by FIG. 1 as viewed from the opposite side.

Referring first to FIGS. 1 and 2, a more or less conventional trigger housing 21 including a trigger lever 22 mounted to pivot on a trigger pivot 23 between a pair of support plates 24, 25 is modified by the inclusion of an electro-mechanical device 26 rigidly mounted by support structure 27 in fixed relation with respect to the other components of the assembly 21. The electro-mechanical device 26 includes a solenoid coil member 28 and reciprocating core member 29, as may best be seen from FIG. 8.

Figure 8:
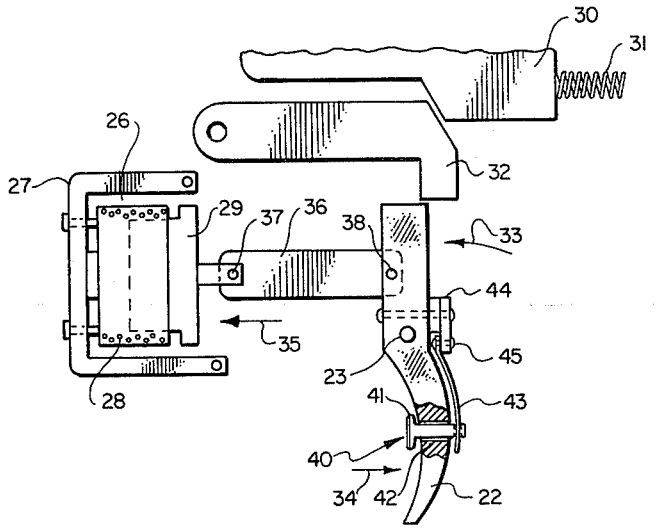
FIG. 8 illustrates a firing mechanism assembly of this invention.

From FIG. 8, it may further be seen that this invention provides for two modes of discharging a firearm. The firearm includes a conventional striker 30 constantly biased forward by a mainspring 31. When the firearm is cocked, as shown by FIG. 8, the striker is held in cocked condition by a sear 32. Rotation of the trigger lever 22 in the direction indicated by arrow 33 permits the sear 32 to fall, thereby releasing the firing mechanism (striker 30 and associated components) to discharge the firearm. Rotation of the trigger lever 22 as indicated by arrow 33 may be effected either by finger pressure on the trigger lever as indicated by arrow 34 or by reciprocation of the core 29 in the direction indicated by arrow 35. Force is transferred from the core 29 through the trigger 22 through a mechanical link 36. This link 36 is connected with pivots 37, 38 at its opposite ends and contributes negligibly to the "feel" of the mechanical trigger system. The trigger switch 40 is mounted within the trigger lever 22, as shown, and constitutes a portion of the electronic trigger circuit illustrated by FIGS. 9 and 10 and described more fully hereinafter. A conductive button member 41 is reciprocally mounted within a non-conductive insert 42. It is normally biased away from contact with the trigger by means of a conductive spring 43 which is mounted through an insulating assembly 44 to the trigger lever 22. A wire 45 connects the member 41 into the trigger circuit. The trigger lever 22 is at reference potential (the ground potential of the electronic circuits carried by the firearm). Depressing the floating member 41 until it contacts the metallic surface of the trigger lever 22 closes the switch 40 thereby energizing the coil 28. When the coil 28 is energized, the core 29 moves in the direction indicated by the arrow 35 thereby pivoting the trigger lever as indicated by the arrow 33 to release the firing mechanism 30 of the firearm.

Figure 9:
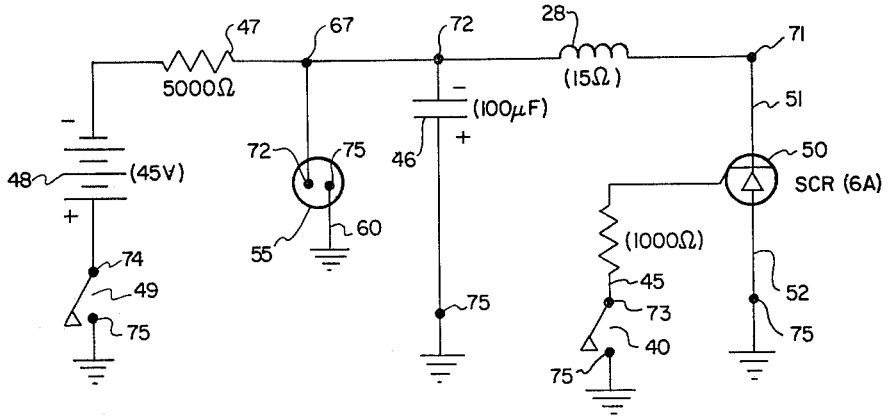
FIG. 9 is a schematic diagram of the electronic circuitry of one embodiment of this invention.
Figure 10:
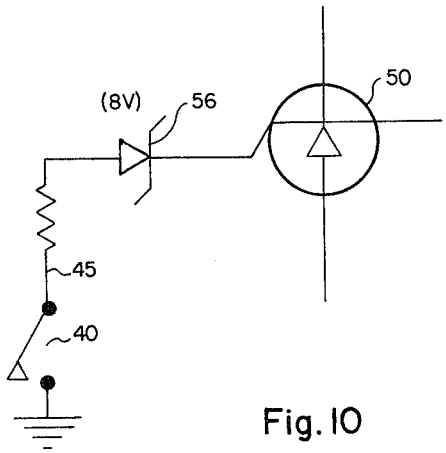
FIG. 10 illustrates a modification of a portion of the circuitry of FIG. 9.

Operation of the electronic aspects of this invention will be best understood by reference to FIGS. 9 and 10. Practical values of the circuit components are indicated on the drawing by way of illustration only. As illustrated, an RC charging circuit includes a capacitor 46, resistor 47 and battery 48. The positive plate of the capacitor 46 is connected directly to ground (the frame of the firearm) and the positive side of the battery 48 is connected to ground through a set switch 49. (See FIG. 5 for the physical location of such a switch in a practical firearm.) With switch 49 closed, capacitor 46 will charge to battery potential in accordance with the time constant of the circuit. Discharge of capacitor 46 may be accomplished by closing trigger switch 40, thereby placing SCR 50 into a conductive state so that capacitor 46 discharges through solenoid coil 28 through the cathode 51/anode 52 circuit of SCR 50 to ground. Alternatively, capacitor 46 may be discharged directly to ground without energizing coil 28 by closing safety switch 55. A practical embodiment of the safety switch 55 is illustrated by FIG. 7. FIG. 10 illustrates a modification whereby a bias is applied to the gate circuit of the SCR 50 to prevent the SCR from turning on when switch 40 is closed if the capacitor is less than fully charged. As illustrated, the bias voltage is provided by the inclusion of a Zener diode 56.

Referring specifically to FIG. 7, the grounded terminal 60 of the safety switch 55 is embodied as the finger piece of a typical firearm. As shown, the finger piece includes a roller link 61 which is at ground potential due to its physical contact with the frame of the firearm. When the mechanical safety is operated to put the mechanical firing components of the gun in its safe mode, the rotor link 61 is moved in the direction shown by the arrow 62 to contact the electronic safety spring 63. The safety spring 63 is carried by a circuit board 64 as best seen from FIG. 7A. The top of the circuit board 64 is shown by FIG. 7B while the bottom surface of the board 64 is shown by FIG. 7C. The spring 63 is held by a pair of rivets 65 which provide a conductive path through the circuit board insulator 64 to the conductive strip 66 which includes a terminal point 67. The circuit board 64 illustrated in FIG. 7 represents a special case of the more generalized circuit board structure illustrated by FIGS. 6A and 6B of FIG. 6 wherein the terminal 67 is also indicated.

Figure 3:
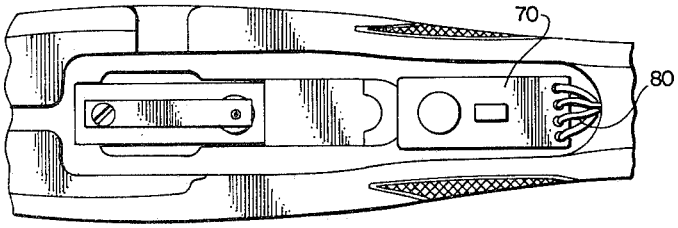
FIG. 3 is a fragmentary pictorial view showing a portion of the stock assembly of a bolt action rifle as viewed from beneath.
Figure 4:
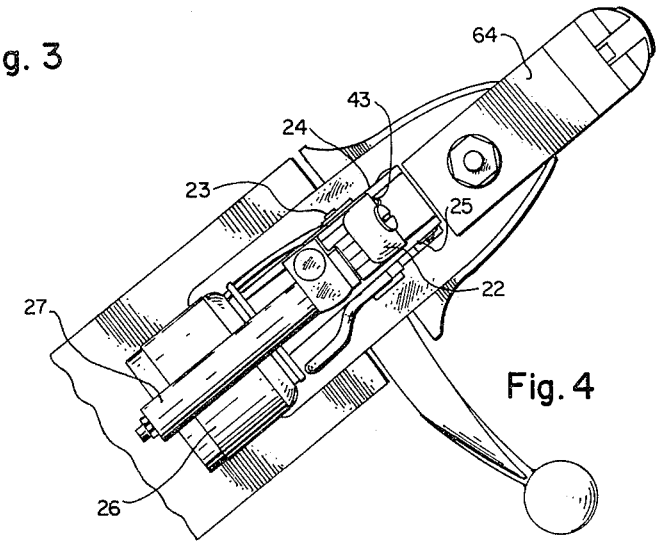
FIG. 4 illustrates the trigger assembly of FIGS. 1 and 2 installed in the frame of a bolt action rifle.

FIGS. 6A and 6B correspond to FIGS. 7B and 7C in that they represent the top and bottom surfaces, respectively, of a circuit board 64 carried by the trigger housing of a firearm. This circuit board component 64 is also visible in FIGS. 1, 2 and 4. FIG. 6C shows the bottom surface and FIG. 6D shows the top surface of a circuit board component 70 adapted to mate with the circuit board component 64. The circuit board 70 is mounted in the stock of the firearm, as may be seen from FIG. 3. The solder terminals of the circuit board component 64, 70 are identified in FIGS. 6A, 6B, 6C, 6D and 9. It can thus be seen that when the firearm is assembled, as shown in FIG. 5, the bottom surface (FIG. 6B) of the circuit board 64 is clamped tight against the top surface (FIG. 6D) of a circuit board 70, thereby completing interconnection of all of the circuitry components illustrated by FIG. 9.

Referring again to FIG. 9, it should be understood that the switches 40, 49 and 55, as well as the coil 28 and core 29, will ordinarily be the only components carried by the trigger assembly. All other components will ordinarily be housed within the stock assembly. The use of the circuit board 64 and 70 make it possible to confine wiring 80 of discrete components to well protected locations within the trigger housing and stock.

Figure 11:
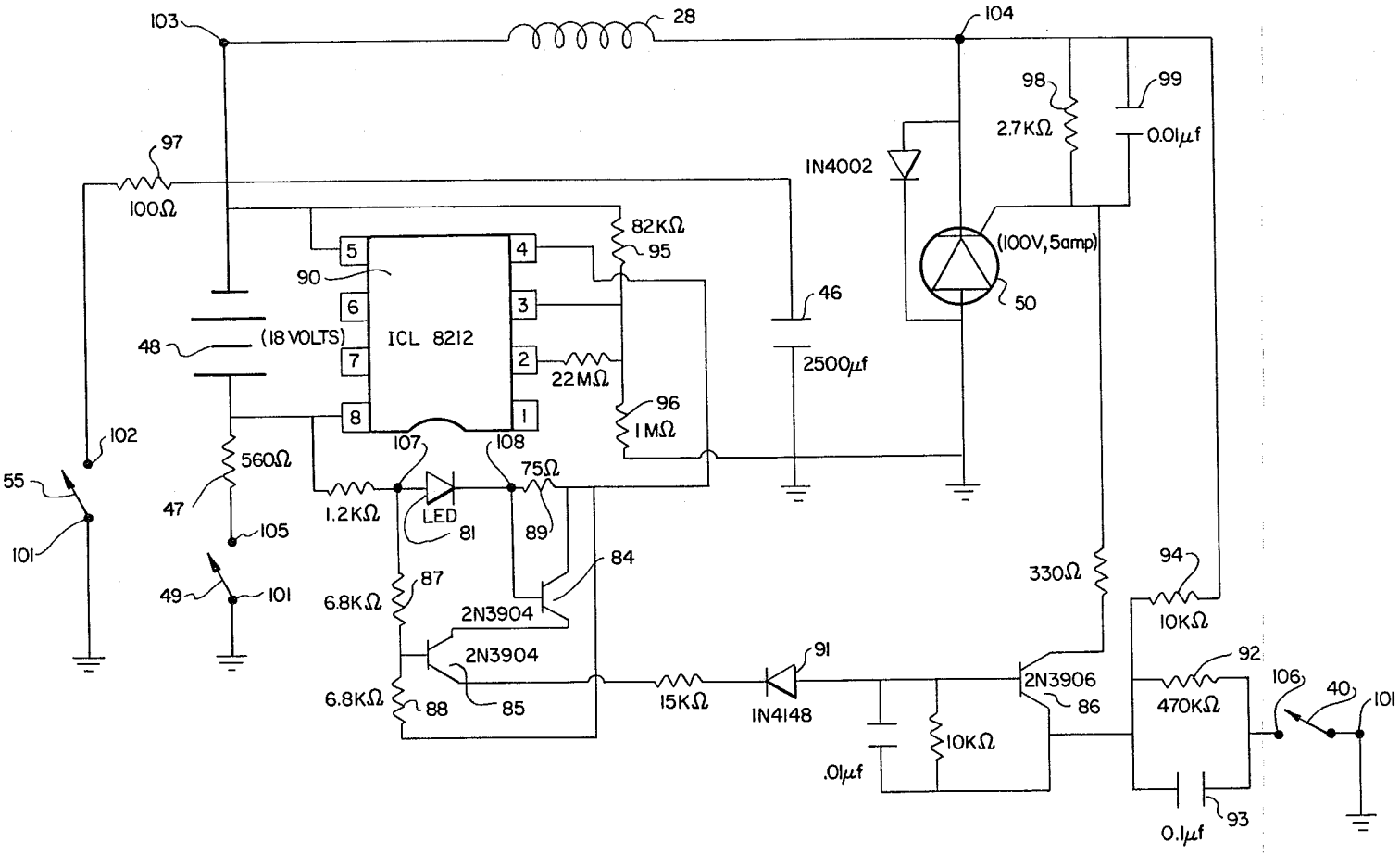
FIG. 11 is a schematic diagram of the electronic circuitry of an alternative embodiment of this invention.
Figure 12:
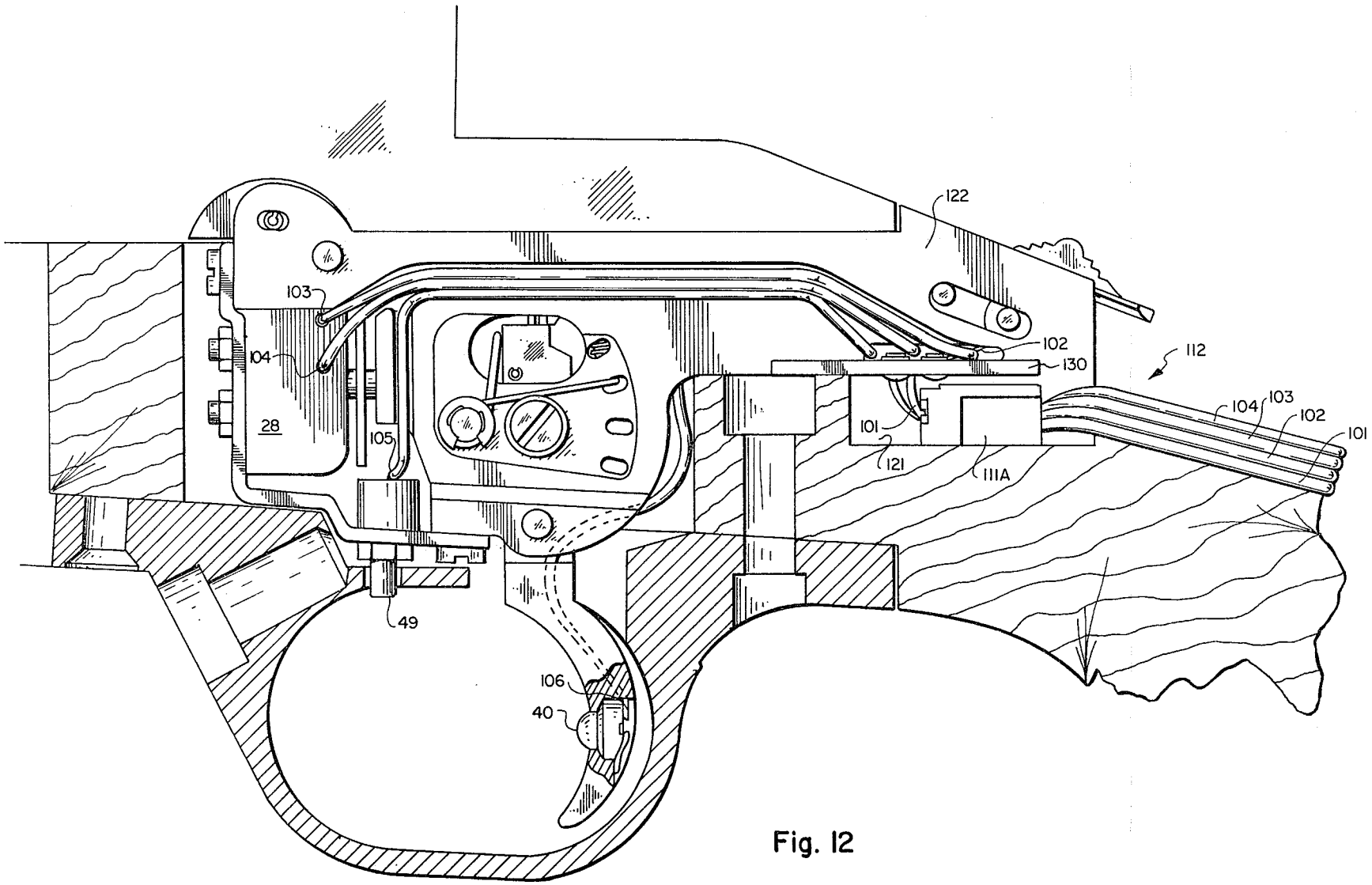
FIG. 12 is a fragmentary view in cross-section of a portion of a firearm incorporating the electronic circuitry of FIG. 11.
Figure 13A:
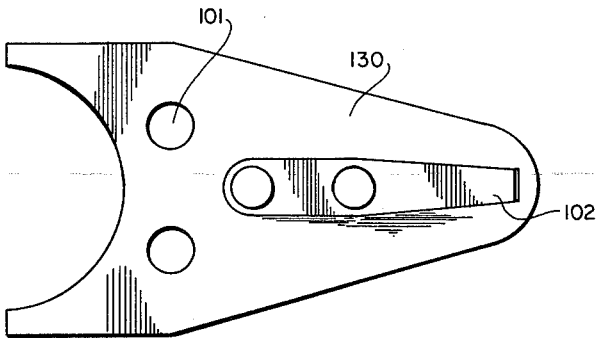
FIG. 13A is a top plan view, 13B is a side elevation view and 13C a bottom plan view of a safety component included in FIG. 12.
Figure 13B:
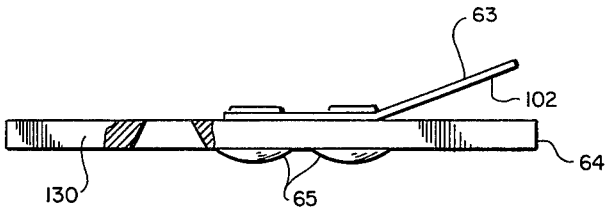
Figure 13C:
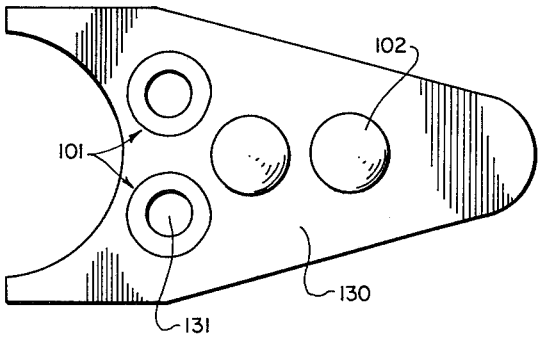

The circuit arrangement illustrated by FIG. 11 and its application to a firearm, as illustrated by FIGS. 12 through 16, is presently regarded as the preferred embodiment of the invention. Major components which are substantially identical to those of FIG. 9 are identically numbered, although in some instances different practical values may be indicated.

A principal feature of the preferred circuit of FIG. 11 is its inclusion of light emitting diode (LED) 81 (in the illustrated instance, a 5082-4684 series from Hewlett-Packard), to indicate when the firearm's set trigger is activated. The circuit includes means for disabling the firearm in the event the LED 81 should fail. In other words, the operator of the firearm will be assured that the firearm will not discharge electronically if the LED 81 is unlit, whether or not it is functioning normally.

Another feature of the embodiment illustrated by FIGS. 12 through 16 in connection with the circuit of FIG. 11 is the use of plug connectors rather than circuit boards to interconnect the components carried in the stock of the firearm with those carried in association with the frame.

The circuit of FIG. 11 functions generally similarly to that of FIG. 9, and the following description will avoid duplication to the extent practicable. Practical values of each component are indicated on the drawing for the sake of completeness.

The safety circuit illustrated in connection with the LED 81 will not interfere with normal operation of the SCR 50 to discharge the firearm in the fashion previously described so long as the LED 81 is functioning normally. In that case, current is applied to the bases of both transistors 84 and 85. They thus both conduct, causing current flow from the base of the transistor 86, so that it is enabled to conduct current from collector to emitter. Thus, when the trigger switch 40 is closed, transistor 86 conducts current so that a positive voltage is applied on the gate of SCR 50, thereby firing the firearm.

If a short circuit arises in the LED 81, the current supplied to the LED 81 is split into two paths. One path passes current through two large value resistors 87, 88, while the other path passes current through a relatively small resistor 89. Under these circumstances, almost all of the current is applied to the base of transistor 84, and a negligible amount is applied to the base of transistor 85. The transistor 85 thus remains non-conductive, causing the transistor 86 to remain non-conductive. The SCR 50 thus cannot fire, even if the trigger switch 90 is closed. Similarly, if the LED 81 should fail in an open circuit mode, no current will flow through the resistor 89, and transistor 84 will remain non-conductive. Thus, no current will be drawn from the base of transistor 86, and SCR 50 cannot fire when the trigger switch 40 is closed.

The specific circuit configuration of FIG. 11, utilizes an integrated circuit (IC) 90 to control the operation of LED 81. In operation, when that occurs, pin 4 of the IC 90 will sometimes be at high potential. The base/collector junction of the transistor 85 would then tend to become forward biased. This condition would enable current to flow to the gate of SCR 50, thereby causing a misfire. The diode 91 is incorporated to prevent such an occurrence.

The resistor 92 and capacitor 93 produce a brief trigger pulse only when the trigger switch 40 is closed. The emitter of transistor 86 is maintained at near the quiescent potential of the cathode of the SCR 50, regardless of the state (conductive or non-conductive) of the transistor 86 because of the influence of the resistor 94. These expedients prevent misfiring of the SCR 50 as the capacitor 46 approaches full charge while the trigger switch 40 is either shorted for some reason or inadvertently held closed.

In the configuration illustrated by FIG. 11, the firearm will discharge (the SCR 50 will operate) when the capacitor 46 is charged to 15 volts. The IC 90 senses this voltage and turns on the LED 81 ("ready" light). The charge on capacitor 46 will eventually drain of its own accord if the trigger switch 40 is not closed, but the LED 81 will remain lit until the capacitor 46 has drained to below 14.5 volts. At this potential, the SCR 50 will not fire. As shown, the LED 81 will remain lit for approximately three minutes if the capacitor 46 is charged to 18 volts (the full potential of the battery 48 of FIG. 11). The resistors 95 and 96 are desirably of rigid tolerances (1%) to assure proper operation of the IC 90. A much greater tolerance (10%) is permissible for the other resistors in the circuit. A switch (not shown) may be placed between the battery 48 and the IC 90 to increase battery life. The battery 48 of FIG. 11 may comprise two 9-volt alkaline batteries connected in series. If they are not isolated from the IC 90, their anticipated useful life would be approximately a half year to a year.

The resistor 97 protects the safety switch 55 by limiting the current that passes across it when the capacitor 46 is discharged through it. The parallel combination of resistor 98 and capacitor 99 is included to shunt any stray signal (radio or high tension wires) from the gate of the SCR 50, thereby avoiding any possible misfiring caused by such signals.

Figure 15:
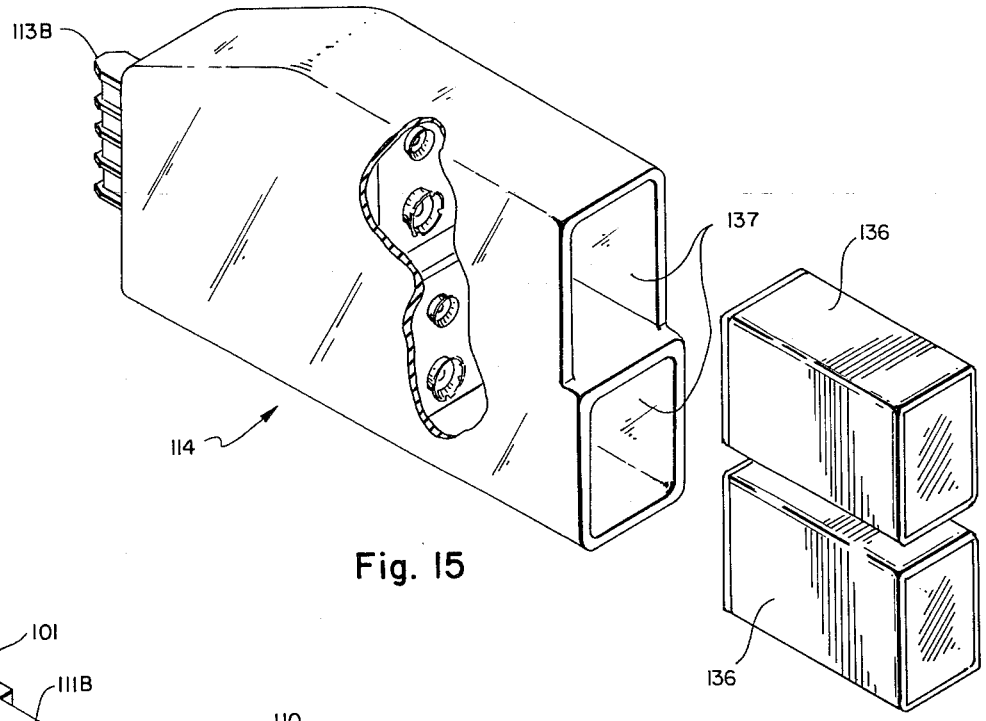
FIG. 15 is a pictorial view of a stock module adapted to the stock of FIG. 14.
Figure 16:
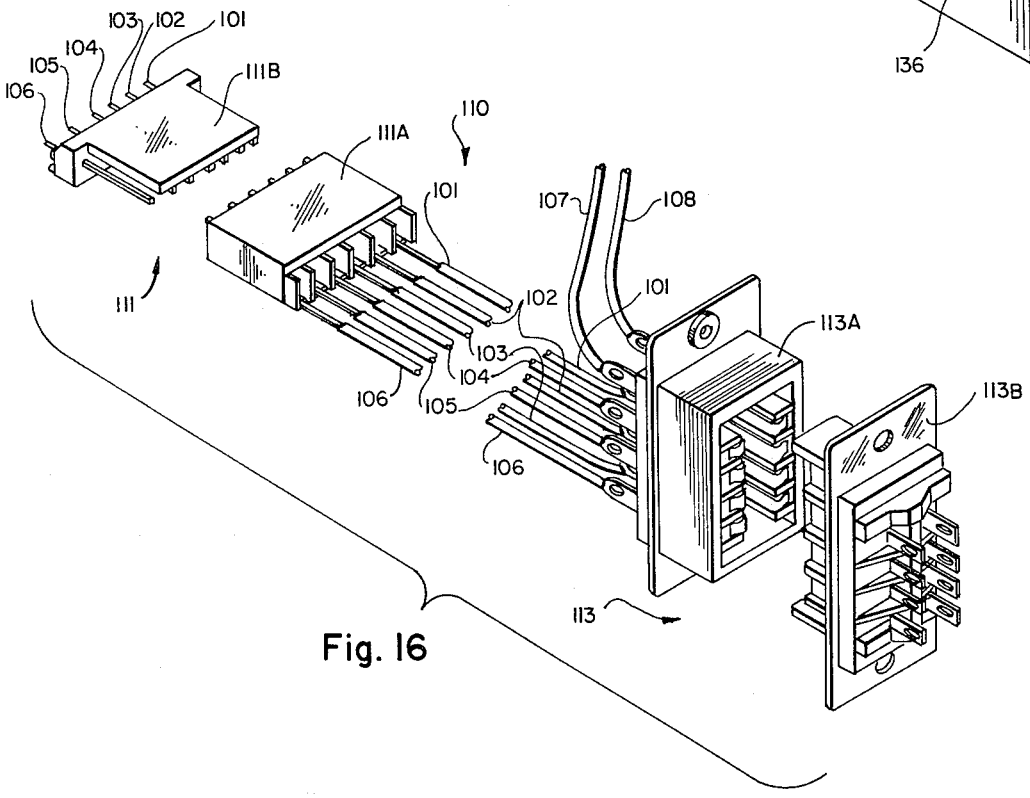
FIG. 16 is a pictorial view of a wiring harness adapted to interconnect the stock module of FIG. 15 with components shown by FIGS. 12 and 14.

Various nodes, identified 101 through 108, respectively, of FIG. 11, represent connection points for the wiring harness of FIG. 16, designated generally 110. The individual wires of the harness 110 are numbered to correspond to the nodes of the circuit. One end of the harness, carrying a 6 pin plug, designated generally 111, is shown in place within the stock and frame of a firearm 112 in FIG. 12. The opposite end of the harness 110, carrying an 8 pin plug, designated generally 113, is adapted to a stock module 114, illustrated by FIG. 15. The relationship of the module 114, harness 110 and firearm 112 is best shown by FIG. 14.

The wiring harness 110 is housed within the stock 120 of the firearm 112 with the female end 111A of the plug 111 firmly held in a channel 121 (FIG. 12) adapted to receive a portion of an assembly 122 carrying the male portion 111B of the plug 111. As shown, the plugs 111 and 113 are crimp type, although other types may be used, provided they offer excellent and positive conduction paths through the pins. The female portion 113A of the plug 113 is held in place within the stock in a channel 123 (FIG. 14), and the male portion 113B of that plug is carried by the stock module 114 (FIG. 15). The wires 107, 108 of the harness are fed through a bore 125 to a receptacle 126 in the stock 120 for the LED 81. The remaining six wires 101 through 106 of the harness pass through the bore 128. The connection of the harness 110 through the plug 111 to the components carried by the frame 122 is apparent from FIG. 12, except that the common ground wire 101 connection is more apparent from FIG. 13 which shows more clearly the safety switch 55 components carried by PC board 130. Means 131 are provided for attaching the board 130 directly to the frame 120 which is at ground potential. The frame 120 is hand-wired 101 to the plug 111 to carry this potential to the module 114.

Figure 14:
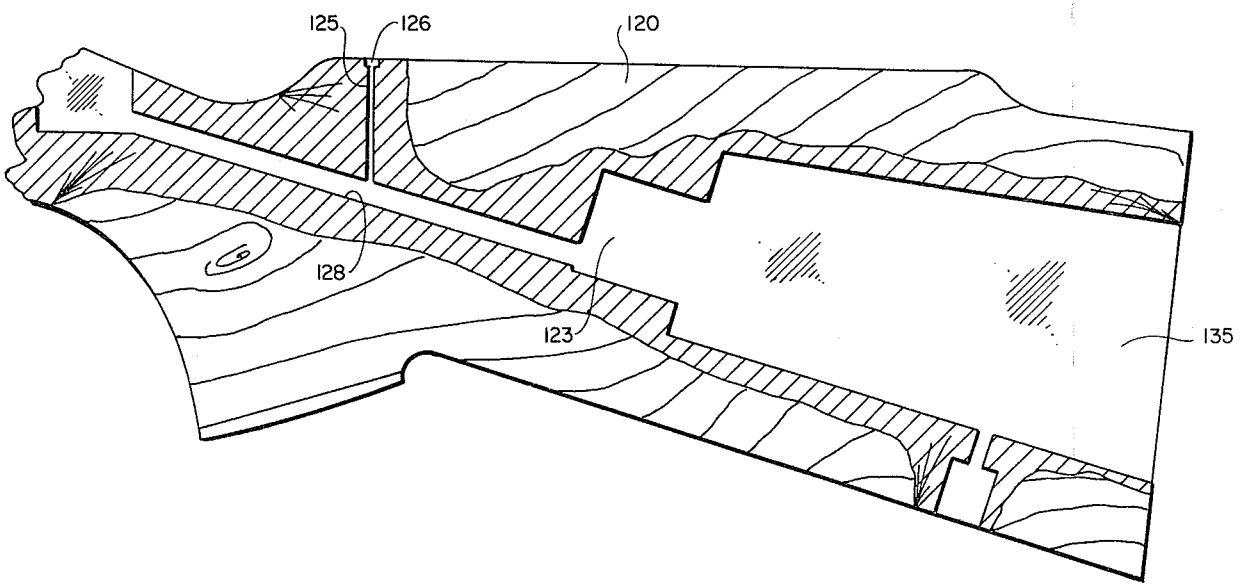
FIG. 14 is a view in side elevation, partially in section, of a portion of the stock of the firearm of FIG. 12.

As best shown by FIGS. 14 and 15, the module 114 may be removed from the stock 120 by pulling it straight back through the access channel 135. This action withdraws the male portion 113B of the plug 113 so that the entire module is disconnected mechanically and electrically from the system. The batteries 136 carried by chambers 137 may similarly be withdrawn for replacement as required.

Reference herein to details of the illustrated embodiment is not intended to limit the scope of the claims which themselves set forth those details regarded as essential to the invention.

We claim:

1. In a firearm which has firing mechanism including a sear operable to hold the firing mechanism in cocked condition and to release said firing mechanism in response to operation of a trigger lever, an electronic set trigger, comprising:

an electro-mechanical device, including:

a solenoid coil connected in circuit with a capacitor and an electronic trigger circuit, and a reciprocating core, mechanically linked to said trigger lever to operate it to release said firing mechanism in response to current flow from said capacitor through said coil;

power supply means connected in a charging circuit with said capacitor to charge said capacitor without energizing said coil; and a trigger switch associated with said trigger circuit means for discharging said capacitor through said coil when placed in conductive condition.

2. An electronic set trigger according to claim 1 including a safety switch connected in circuit with said capacitor for discharging said capacitor without energizing said coil.

3. An electronic set trigger according to claim 1 wherein the coil and core characteristics are selected to require a fixed minimum current flow to release said firing mechanism, the capacitor is selected to store a set trigger charge sufficient to provide said minimum current flow upon discharge, the charging circuit has a time constant sufficient to require a safe interval of time for the capacitor to store said set trigger charge, and the charging circuit includes a normally open switch constituting means for selectively closing said charging circuit to permit said capacitor to receive said set trigger charge.

4. An electronic set trigger according to claim 3 wherein the time constant of said charging circuit is at least about one second.

5. An electronic set trigger according to claim 1 wherein said trigger switch is mounted in association with the trigger lever of said firearm.

6. An electronic set trigger according to claim 1 wherein said electronic trigger circuit includes a gate controlled solid state switching device connected in parallel with said capacitor with its gate circuit connected to a control voltage through a normally open trigger switch, said capacitor and solid state switch device being connected in series through opposite ends of said coil, so that when said trigger switch is closed, said capacitor is discharged through said coil and said solid state switching device.

7. An electronic set trigger according to claim 1 wherein:

the solenoid coil is mounted within a trigger assembly and the core is connected to the trigger lever to pivot said lever when the coil is energized in the same direction of rotation as said trigger is rotated when pulled by finger pressure, said linkage permitting operation of the sear to release said firing mechanism either by finger pressure or by electronically discharging said capacitor;

the trigger switch is mounted in association with said trigger lever for operation by a trigger finger;

the power supply means is carried by the firearm separate from said trigger assembly; and the stock and trigger assembly of said firearm carrying means are cooperatively adapted to interconnect in circuit relationship said trigger switch, power supply and capacitor.

8. An electronic set trigger according to claim 7 wherein said electronic trigger circuit includes a gate controlled solid state device normally blocking current flow from said capacitor with a gate circuit including said trigger switch operable to open said solid state device in response to closing said trigger switch.

9. An electronic set trigger according to claim 7 wherein:

the frame of said firearm is conductive and is at ground potential;

the power supply and capacitor are connected in parallel in a charging circuit between said coil and said frame, said charging circuit including a narrowly open charging switch and resistance in series with said capacitor; and the trigger circuit is connected between said frame and the side of said coil opposite said charging circuit.

10. An electronic set trigger according to claim 9 wherein:

said coil, core, charging switch and trigger switch are carried by the frame of said firearm;

the power supply capacitor and components of the trigger circuit are carried by the stock of said firearm; and the frame and stock of said firearm carry circuit board elements which mate when said stock and frame are assembled and which are cooperatively adapted to interconnect the circuit component carried by the frame and stock, respectively, into the said charging circuit and trigger circuit and to interconnect said circuits with said coil.

* * * * *